US011203512B2

(12) United States Patent
Key et al.

(10) Patent No.: US 11,203,512 B2
(45) Date of Patent: Dec. 21, 2021

(54) WINCH DRUM TENSION ISOLATION SYSTEM

(71) Applicant: Joy Global Conveyors Inc, Winfield, AL (US)

(72) Inventors: Barry T. Key, Winfield, AL (US); William Tramutolo, Winfield, AL (US)

( * ) Notice: Subject to any disclaimer, the term of this patent is extended or adjusted under 35 U.S.C. 154(b) by 844 days.

(21) Appl. No.: 15/902,607

(22) Filed: Feb. 22, 2018

(65) Prior Publication Data

US 2018/0237277 A1 Aug. 23, 2018

Related U.S. Application Data

(60) Provisional application No. 62/462,533, filed on Feb. 23, 2017.

(51) Int. Cl.

| | |
|---|---|
| ***B66D 5/34*** | (2006.01) |
| ***B66D 1/30*** | (2006.01) |
| ***B66D 1/54*** | (2006.01) |

(52) U.S. Cl.

CPC ..... *B66D 5/34* (2013.01); *B66D 1/30* (2013.01); *B66D 1/54* (2013.01); *B66D 2700/0183* (2013.01)

(58) Field of Classification Search

CPC ... B66D 1/30; B66D 1/54; B66D 5/12; B66D 5/32; B66D 5/34

See application file for complete search history.

(56) References Cited

U.S. PATENT DOCUMENTS

| | | | | |
|---|---|---|---|---|
| 3,021,924 A * | 2/1962 | Patterson, III | ..... | B66D 5/32 188/82.7 |
| 3,668,973 A * | 6/1972 | Kado | ..... | B66D 5/26 91/41 |

(Continued)

FOREIGN PATENT DOCUMENTS

| | | |
|---|---|---|
| GB | 2010766 A | 7/1979 |
| SU | 473664 A1 | 6/1975 |
| WO | 2014158318 A1 | 10/2014 |

OTHER PUBLICATIONS

Search Report issued from the European Patent Office for related Application No. 18157997.0 dated Aug. 22, 2018 (6 pages).

*Primary Examiner* — Sang K Kim
*Assistant Examiner* — Nathaniel L Adams
(74) *Attorney, Agent, or Firm* — Bradley Arant Boult Cummings LLP

(57) ABSTRACT

A winch drum tension isolation system includes a winch drum having an outwardly extending flange. The flange includes a plurality of holes spaced along the flange. The winch drum tension isolation system also includes a locking mechanism positioned proximate the winch drum. The locking mechanism includes a locking member engageable with the flange, the locking member movable between a first position, in which the locking member is received in a first one of the plurality of holes to prevent rotation of the winch drum, and a second position, in which the locking member is spaced apart from the flange to permit rotation of the winch drum. The winch drum tension isolation system also includes a safety release mechanism having a release member that is selectively engageable with a second one of the plurality of holes to permit removal of the locking member.

18 Claims, 9 Drawing Sheets

(56) References Cited

U.S. PATENT DOCUMENTS

| | | | | |
|---|---|---|---|---|
| 3,791,229 | A * | 2/1974 | Liedtke | B66D 5/00<br>74/128 |
| 3,868,091 | A * | 2/1975 | Hoffman | B66D 1/06<br>254/369 |
| 7,226,038 | B1 * | 6/2007 | Wickstrom | B66D 1/54<br>254/276 |
| 2014/0262693 | A1 * | 9/2014 | de Lore | B65G 23/00<br>198/813 |

* cited by examiner

WINCH DRUM TENSION ISOLATION SYSTEM

CROSS-REFERENCE TO RELATED APPLICATIONS

This application claims priority to U.S. Provisional Application No. 62/462,533, filed Feb. 23, 2017, the entire contents of which are incorporated herein by reference.

FIELD OF THE INVENTION

The present invention relates to a conveyor system for an underground and/or above ground mining machine, and in particular to an isolation system for the conveyor system.

BACKGROUND

Large, heavy winches are used in the underground mining industry. These heavy winches are used to keep tension on the conveyors (e.g., belts), which carry material out of the underground mine. The winches include a winch drum (i.e., a rotating piece upon which a winch rope is wound), an electric motor and gearbox for turning the winch drum, and a park brake. Occasionally a conveyor experiences an emergency stop and the park brake sees dynamic braking loads causing it to overheat and seize. The seized park brake ends up trapping stored energy in the conveyor, and the load cannot be released from the seized brake. This situation places operators at risk when attempting to repair or replace the motor and gearbox or park brake.

SUMMARY

In accordance with one construction, a winch drum tension isolation system includes a winch drum having an outwardly extending flange. The flange includes a plurality of holes spaced along the flange. The winch drum tension isolation system also includes a locking mechanism positioned proximate the winch drum. The locking mechanism includes a locking member engageable with the flange, the locking member movable between a first position, in which the locking member is received in a first one of the plurality of holes to prevent rotation of the winch drum, and a second position, in which the locking member is spaced apart from the flange to permit rotation of the winch drum. The winch drum tension isolation system also includes a safety release mechanism having a release member that is selectively engageable with a second one of the plurality of holes to permit removal of the locking member.

In accordance with another construction, a winch drum tension isolation system includes a frame, and a winch drum coupled to the frame. The winch drum includes an outwardly extending flange. The flange includes a plurality of holes spaced along the flange. The winch drum tension isolation system further includes a safety release mechanism coupled to the frame that includes a pin that is selectively engageable with the plurality of holes. The safety release mechanism includes a hydraulic cylinder coupled to the release member and pivotally coupled to the frame.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
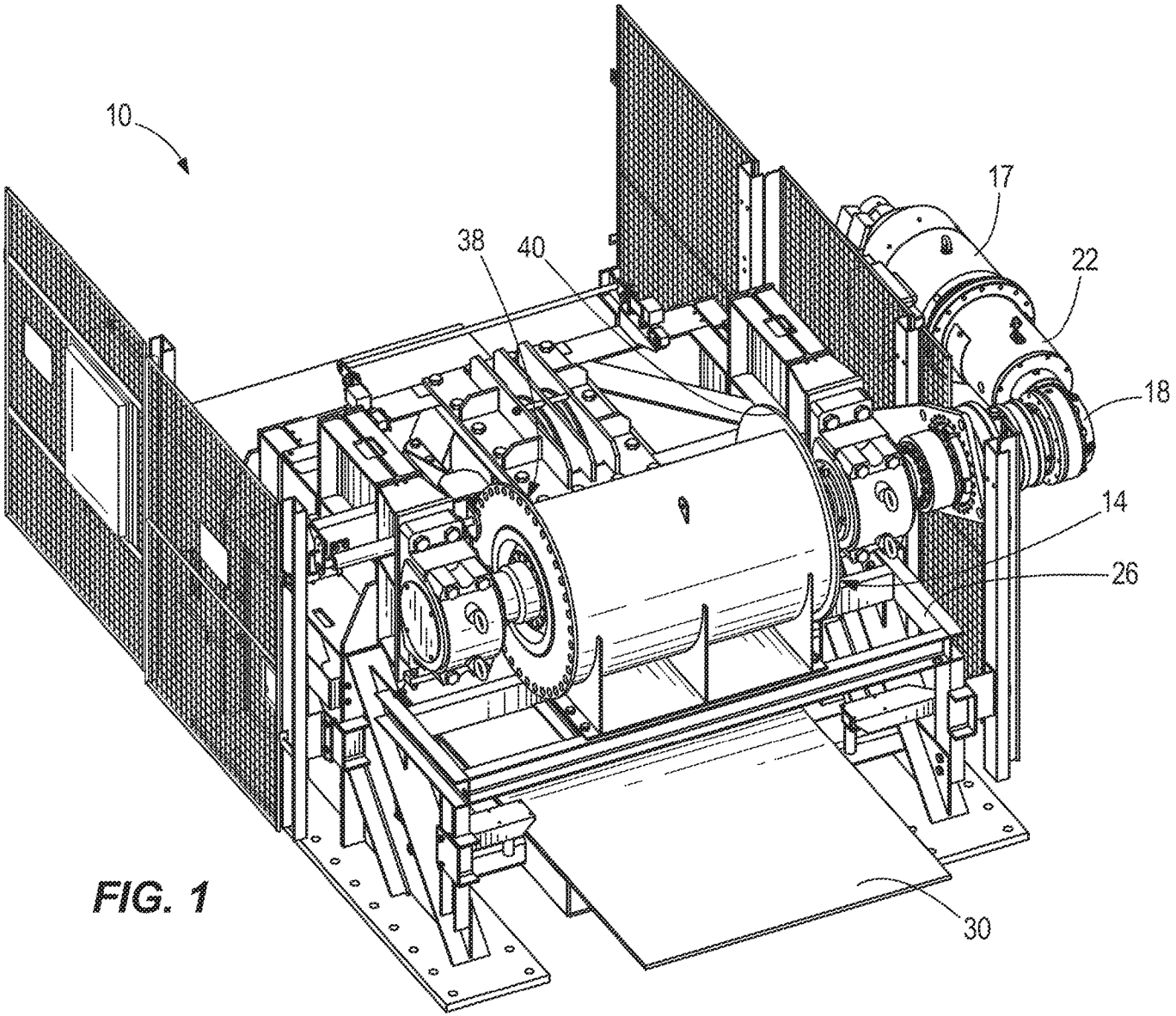
FIG. 1 is an isometric view of an electric winch system.
Figure 2:
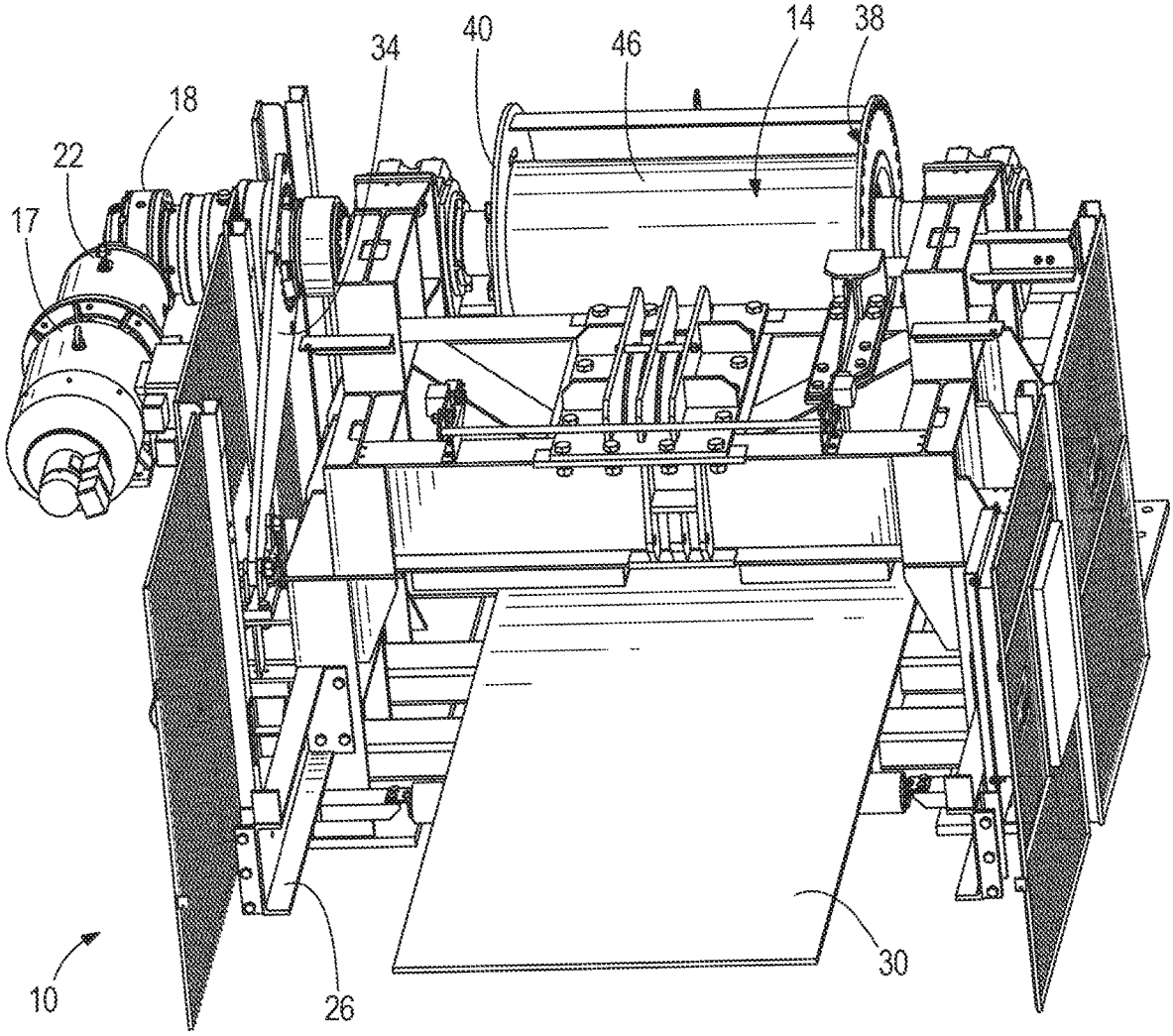
FIG. 2 is an end view of the winch system of FIG. 1.

FIGS. 1 and 2 illustrate an electric winch system 10 that is used in an underground and/or above ground mining environment to create and sustain required belt tension necessary to operate. The winch system 10 includes a winch drum 14, a motor 17 and gearbox 18 that drive rotation of the winch drum 14, and a park brake 22 that provides emergency braking force to the motor 17 and gearbox 18. The winch system 10 also includes a winch frame 26, and a conveyor belt 30 that extends through the winch frame 26. The winch drum 14 is coupled to the winch frame 26. A winch rope (not shown) is wound about the winch drum 14, and is used to move a moveable carriage that creates tension in the conveyor belt 30. The winch drum 14 is a large-scale structure capable of constant application achieving forces necessary to control belt tension during both start and stopping situations. This device also can achieve necessary rope force required during an aborted or an emergency stop.

The winch system 10 also includes a torque arm 34. The torque arm 34 is coupled to both the winch drum 14 and to the winch frame 26, and absorbs torsional stress developed by rotation of the winch drum 14 relative to the frame 26.

With reference to FIGS. 1-6, the winch drum 14 includes a pair of outwardly extending flanges 38, 40 located at opposite ends of the drum 14. In the illustrated construction, the flange 38 located opposite the arm 34 includes holes 42. The flange 38 extends circumferentially about a rotational axis 44 of the drum 14, and the holes 42 are positioned circumferentially about the flange 38. The holes 42 are spaced evenly apart from each other along the flange 38. As illustrated in FIG. 2, the flange 38 is a separate member coupled to a central portion 46 of the winch drum 14. In other constructions, the flange 38 is integrally formed with the central portion 46 or the flange 38 is retrofitted to an existing winch drum 14.

The flange 38 has a diameter greater than a diameter of the central portion 46 of the winch drum 14, and the holes 42 are located generally near an outer edge 50 of the flange 38, such that the holes 42 are located radially exterior to the central portion 46.

Figure 3:
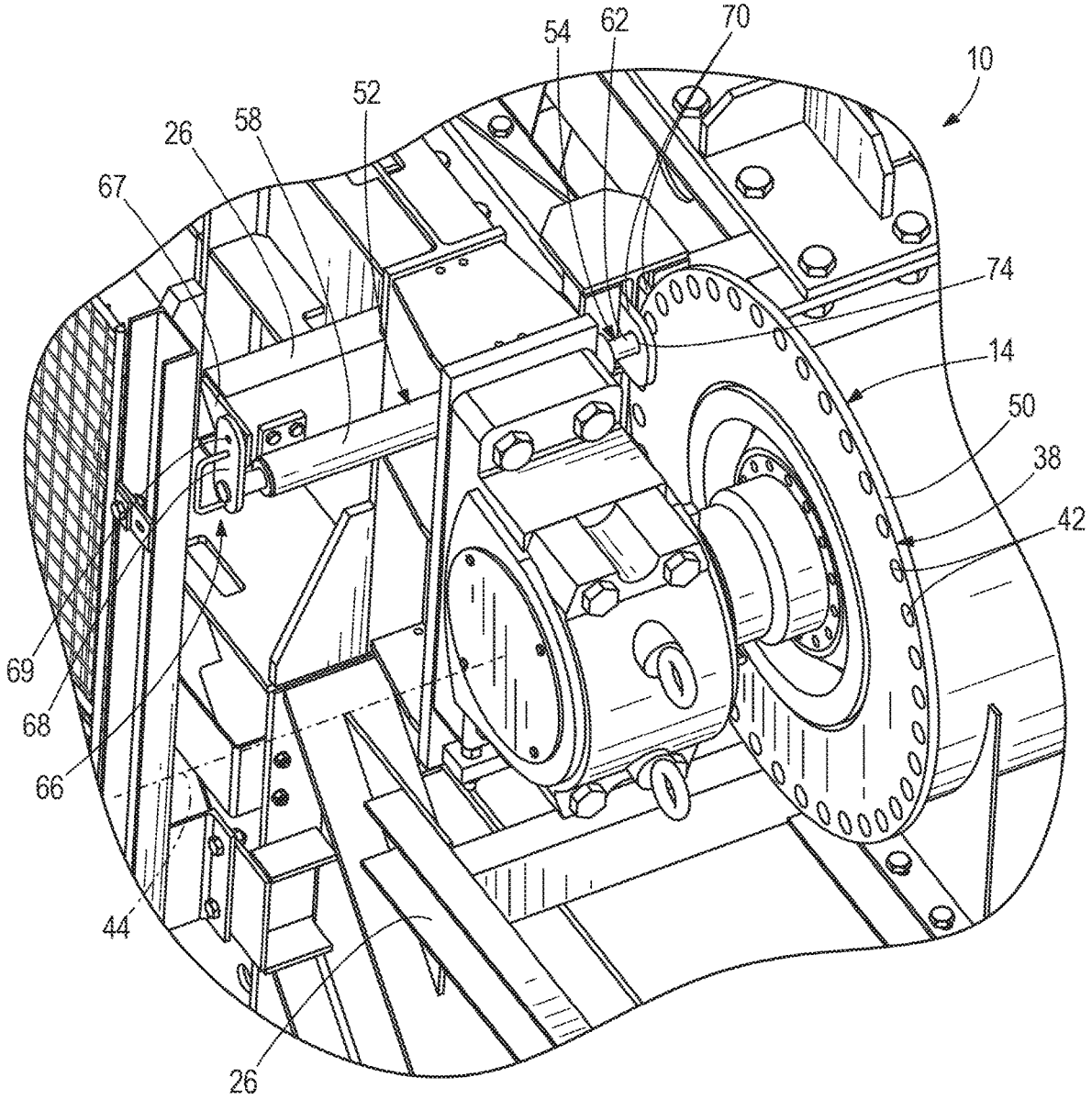
FIGS. 3 and 4 are section detail views of a winch drum tension isolation system for the winch system of FIG. 1.
Figure 4:
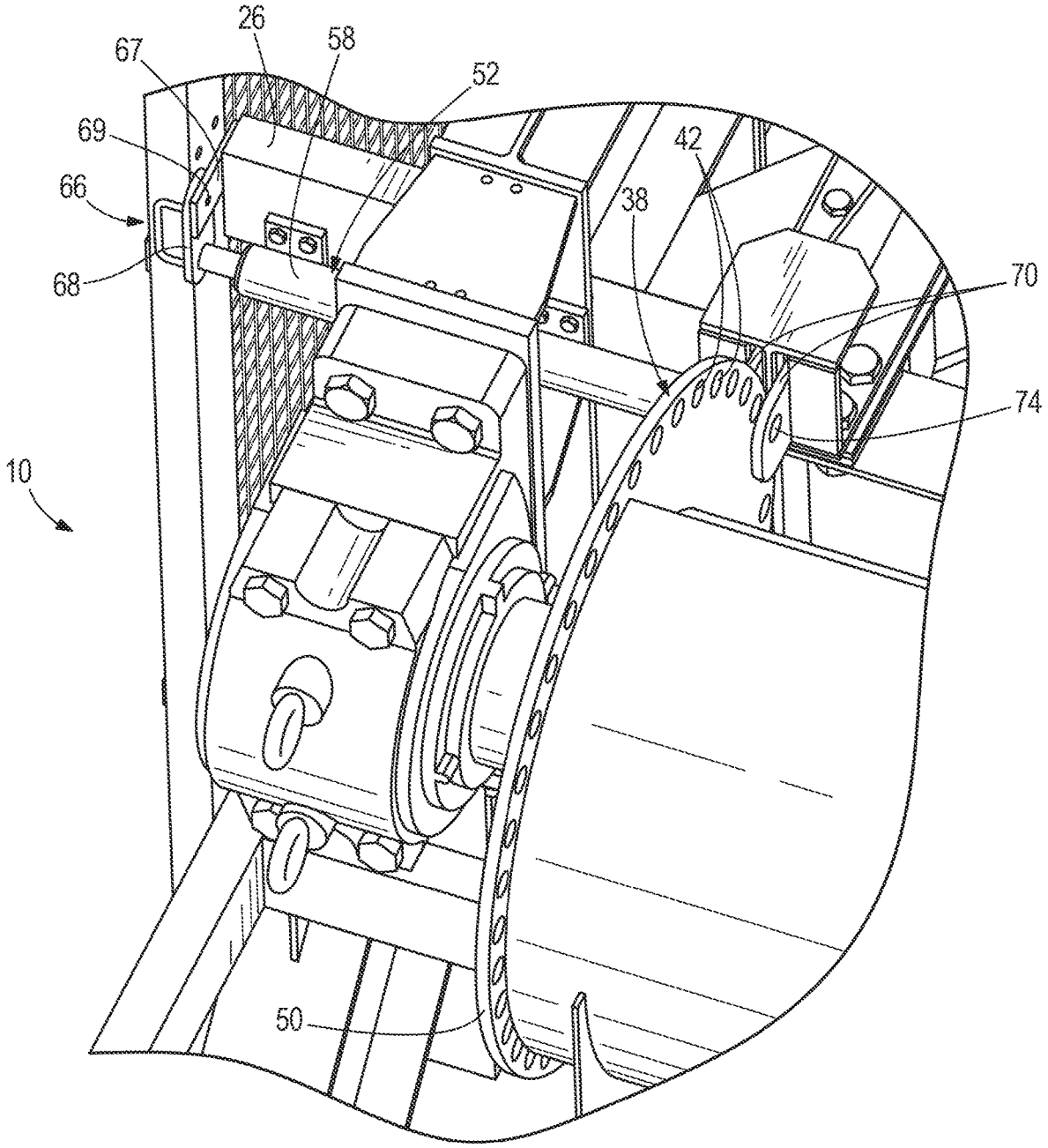
Figure 5:
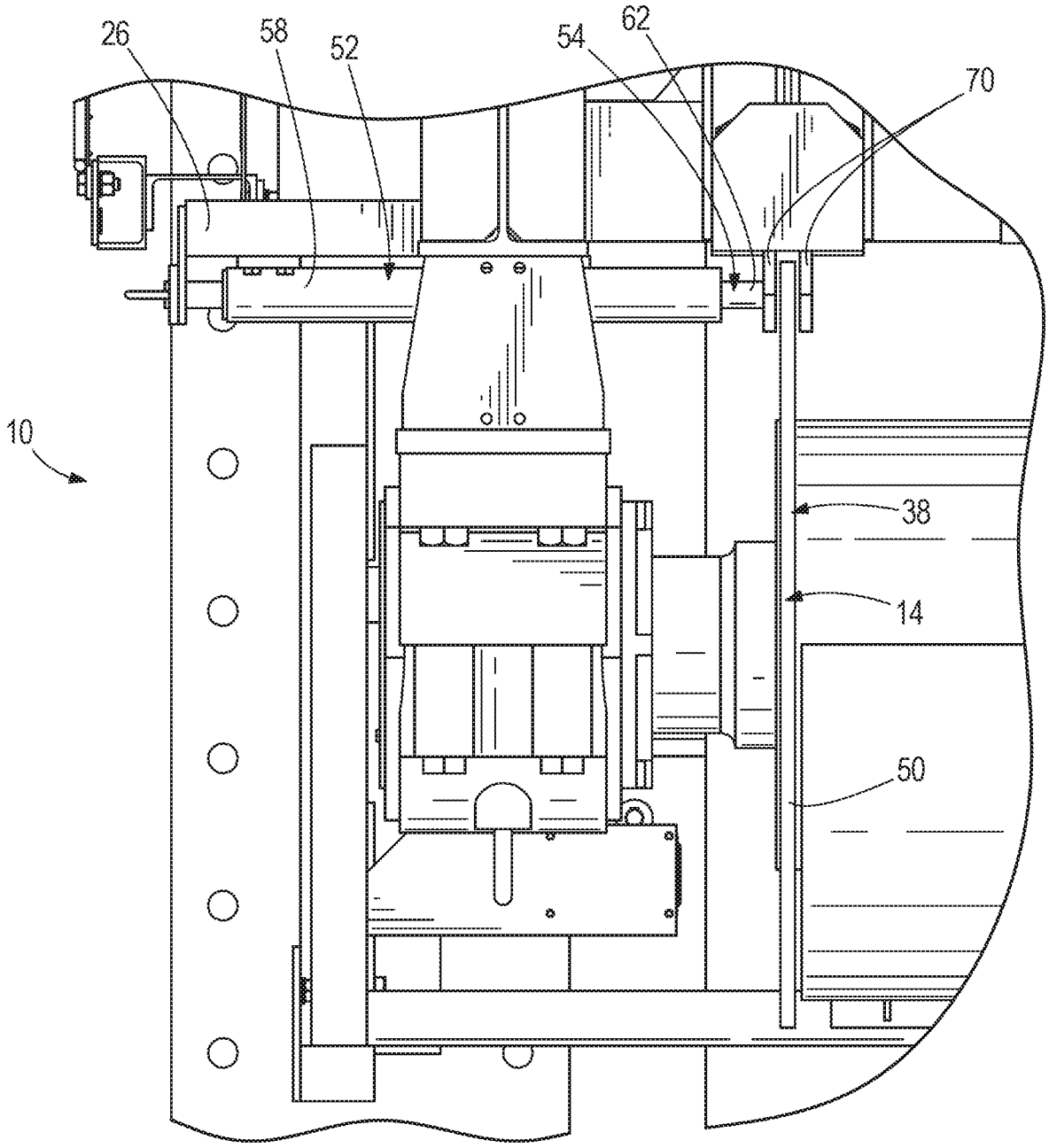
FIG. 5 is a top plan view of the winch drum tension isolation system of FIGS. 3 and 4.
Figure 6:
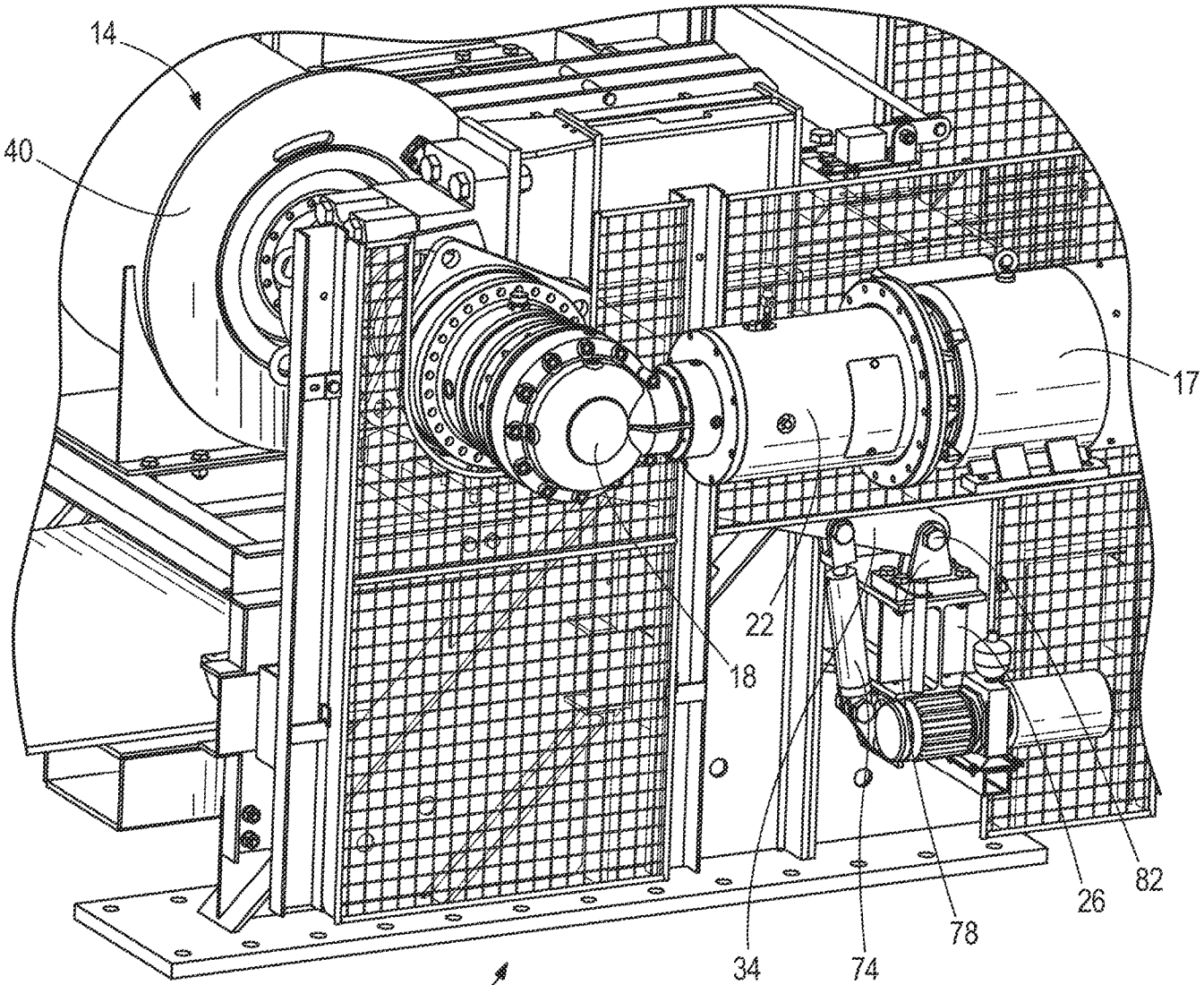
FIG. 6 is a side view of the conveyor system of FIG. 1, illustrating a ram for actuating a gearbox torque arm.

With reference to FIGS. 3-5, the winch system 10 includes a locking mechanism 52 positioned proximate the winch drum 14. The locking mechanism 52, in conjunction with the flange 38, forms part of an overall winch drum tension isolation system that isolates tension build-up in the conveyor 30 in the event of a park brake 22 seizure.

The locking mechanism 52 of the winch drum tension isolation system includes a locking member 54 located within a housing 58. In the illustrated construction, the locking member 54 is a spring-loaded pin disposed in the housing 58, though in other constructions the locking member 54 is another structure, including a spring activated pin, etc. The housing 58 is coupled to the winch frame 26, and the locking member 54 slides within the housing 58. The locking member 54 includes a distal end 62 positioned proximate the flange 38 of the drum 14, and the distal end 62 is received in one of the holes 42 of the flange 38 depending upon a position of the locking member 54. When the locking member 54 is in a first position, the distal end 62 of the locking member 54 is received in one of the holes 42 and the locking member 54 inhibits movement of the drum 14. When the locking member 54 is in a second position, the distal end 62 is spaced apart from and does not engage the flange 38 such that movement of the drum 14 is permitted.

The locking mechanism 52 includes a restraining mechanism 66 that restrains movement of the locking member 54 relative to the winch drum 14. In the illustrated construction, the restraining mechanism 66 includes a flange 67 on the winch frame 26 and a flange 68 on an end of the locking member 54. As illustrated in FIGS. 3 and 4, the flanges 67 and 68 include holes 69. When the restraining mechanism 66 is in a locked position, the holes 69 are aligned, and a bolt (not shown) is passed through the flanges, thereby locking movement of the locking member 54. To release the restraining mechanism 66, the bolt is removed, and the flange 68 is rotated relative to the flange 67 (e.g., 90 degrees) so that the flange 68 is able to move toward the flange 38. Once released, the locking member 54 (i.e., the spring-loaded pin in the illustrated construction) moves toward the flange 38, and the distal end 62 of the locking member 54 moves toward one of the holes 42. In the illustrated construction, a spring element (not shown) is located inside the housing 58 and biases the locking member 54 toward the flange 38. When the restraining mechanism 66 is in a locked position, the spring element maintains potential energy in the spring that is released and causes movement of the locking member 54 toward the flange 38 once the restraining mechanism 66 is unlocked and the flange 68 is rotated. In other constructions, different restraining mechanisms are used, including restraining mechanisms that lock the locking member 54 at more than one position, restraining mechanisms that utilize padlocks to lock the locking member 54, etc.

The locking mechanism 52 is positioned on the winch frame 26 such that the locking member 54, and in particular the distal end 62, is generally aligned radially with the holes 42. Based on rotational positioning of the winch drum 14, the distal end 62 extends through one of the holes 42 when the restraining member 66 is released.

With reference to FIGS. 3-5, the locking mechanism 52 includes guide members 70 located on either side of the flange 38. Each of the guide members 70 includes an opening 74 for receiving the locking member 54 and guiding the locking member 54 into alignment with one of the holes 42.

In the illustrated construction, the flange 38 and the locking member 54 prevent rotation of the winch drum 14 in the case of a brake seizure in the park brake 22, and isolate tension that builds up in the conveyor 30. As noted above, occasionally the conveyor 30 experiences an emergency stop and the park brake 22 sees dynamic braking loads causing the park brake 22 to overheat and seize. The seized park brake 22 ends up trapping stored energy in an elastic belt of the conveyor 30, and the load cannot be released from the seized park brake 22. This situation places operators at risk to replace or repair the motor 17, gearbox 18 or park brake 22, since the winch drum 14 could, if not restrained, suddenly and without warning begin rotating again, thereby releasing the stored energy and causing injury or damage to a nearby operator or the winch system 10.

In order to remove the stored energy safely, the flange 38 and the locking member 54 are utilized to lock rotation of the winch drum 14 and isolate the tension in the conveyor 30 while replacement and/or repairs are made. In particular, if the distal end 62 of the locking member 54 is aligned with one of the holes 42 after seizure, the restraining mechanism 66 is released (as described above), and the distal end 62 of the locking member 54 moves towards the hole 42. In the illustrated construction, the locking member 54 is a biasing member biased toward the holes 42 by a spring element (not shown). Thus, when the restraining member 66 is released, the locking member automatically moves toward the aligned hole 42.

With the locking member 54 received by the aligned hole 42 and the guide members 70, rotation of the winch drum 14 is prevented. With rotation of the winch drum 14 prevented, the motor 17, gear box 18, park brake 22, and/or other structure are removed and/or repaired, and the stored energy is removed safely without the risk of the winch drum 42 causing injury or damage.

If the distal end 62 of the locking member 54 is not aligned with one of the holes 42 after seizure, then the torque arm 34 is used to rotate the winch drum 14 until one of the holes 42 aligns with the distal end 62 of the locking member 54. For example, and with reference to FIG. 6, the torque arm 34 is raised or lowered via a ram 74, though in other constructions other mechanisms are used. The ram 74 is connected to an external hydraulic system, hand pump, or other source of pressure (not shown). Additionally, the torque arm 34 is coupled to an anchor point 78, which is coupled to the winch frame 26 by an anchor pin 82. In order to initially release the anchor pin 82 (which is under a load), the ram 74 is activated to move the torque arm 34 slightly, relieving the stress on the anchor pin 82, such that the anchor pin 82 is removed, and the torque arm 34 is then rotated until one of the holes 42 is aligned with the distal end 62 of the locking member 54.

The motor 17 and gearbox 18 are advantageously not needed to rotate the winch drum 14 such that one of the holes 42 in the flange 38 aligns with the locking member 54. Rather, the torque arm 34 is raised or lowered solely with the ram 74 so as to rotate the winch drum 14 in either direction about the rotational axis 44, until one of the holes 42 is aligned with the locking member 54. With the hole 42 aligned, the restraining mechanism 66 is then unlocked, for example by removing a bolt from holes 69 and rotating the flange 67 relative to the flange 68, and the distal end 62 of the locking member 54 is biased (in the illustrated construction automatically via the biasing force of the spring element) toward the flange 38 until the distal end 62 is seated in the aligned hole 42 and the guide members 70, thereby locking rotation of the winch drum 14.

Once the motor 17, gear box 18, park brake 22, and/or other structure is repaired and/or replaced, the locking member 54 is removed from the hole 42 (e.g., by a user or machine pulling the locking member 54 from the hole 42 while gripping the flange 68). The torque arm 34 is moved again with the ram 74, and the anchor pin 82 is inserted back in the anchor point 78. With the locking member 54 removed, the restraining mechanism 66 is applied to the locking member 54 to prevent the locking member 54 from re-engaging the flange 38. In the illustrated construction, the flange 68 is rotated relative to the flange 67 until the holes 69 align, and the bolt is placed back in the holes 69.

FIGS. 7-10 illustrate a winch system 110 that is used in an underground mining environment to move material out of, or within, the underground mine. The winch system 110 includes a winch drum 114, as well as a motor 117 and a gearbox 118 (FIG. 7) that drive rotation of the winch drum 114. In contrast to the winch system 10, the gearbox 118 is disposed internal to the winch drum 114, as opposed to being disposed external to the winch drum 114. In some constructions, the winch system 110 further includes a park brake, similar to the winch system 10 described above. In some constructions, the motor 117 is also at least partially disposed in the winch drum 114.

Figure 7:
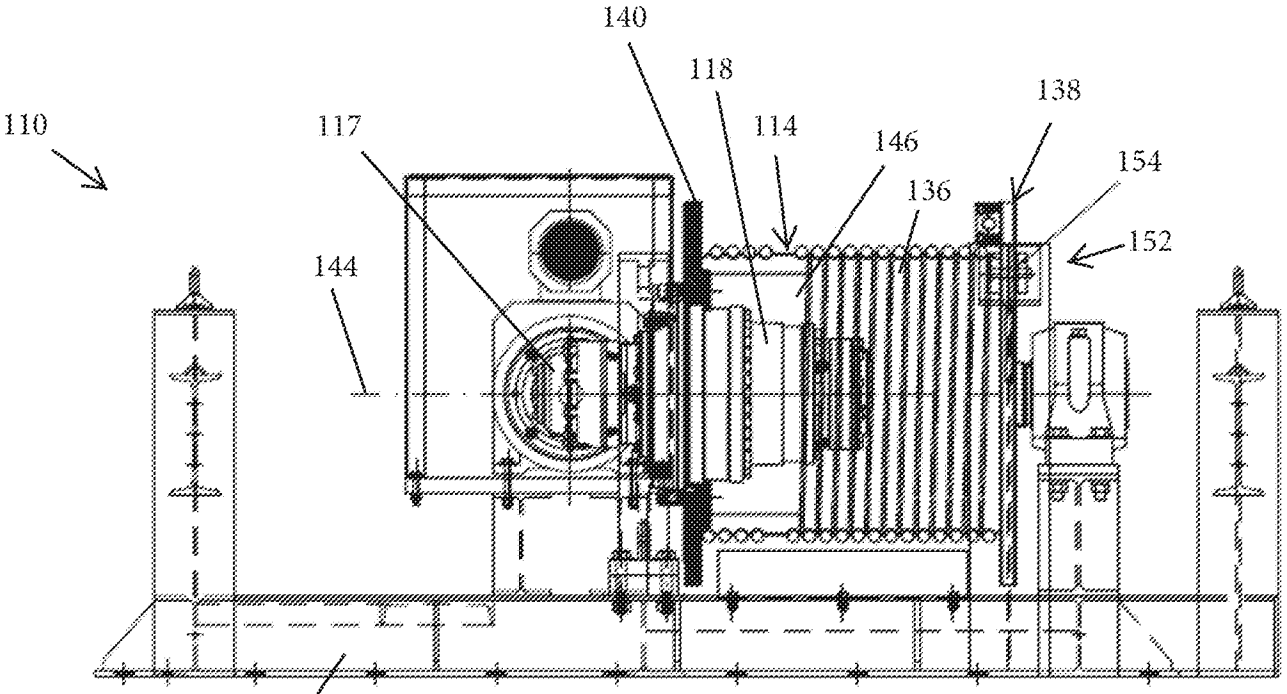
FIG. 7 is a schematic front view of a winch system according to another construction.
Figure 8:
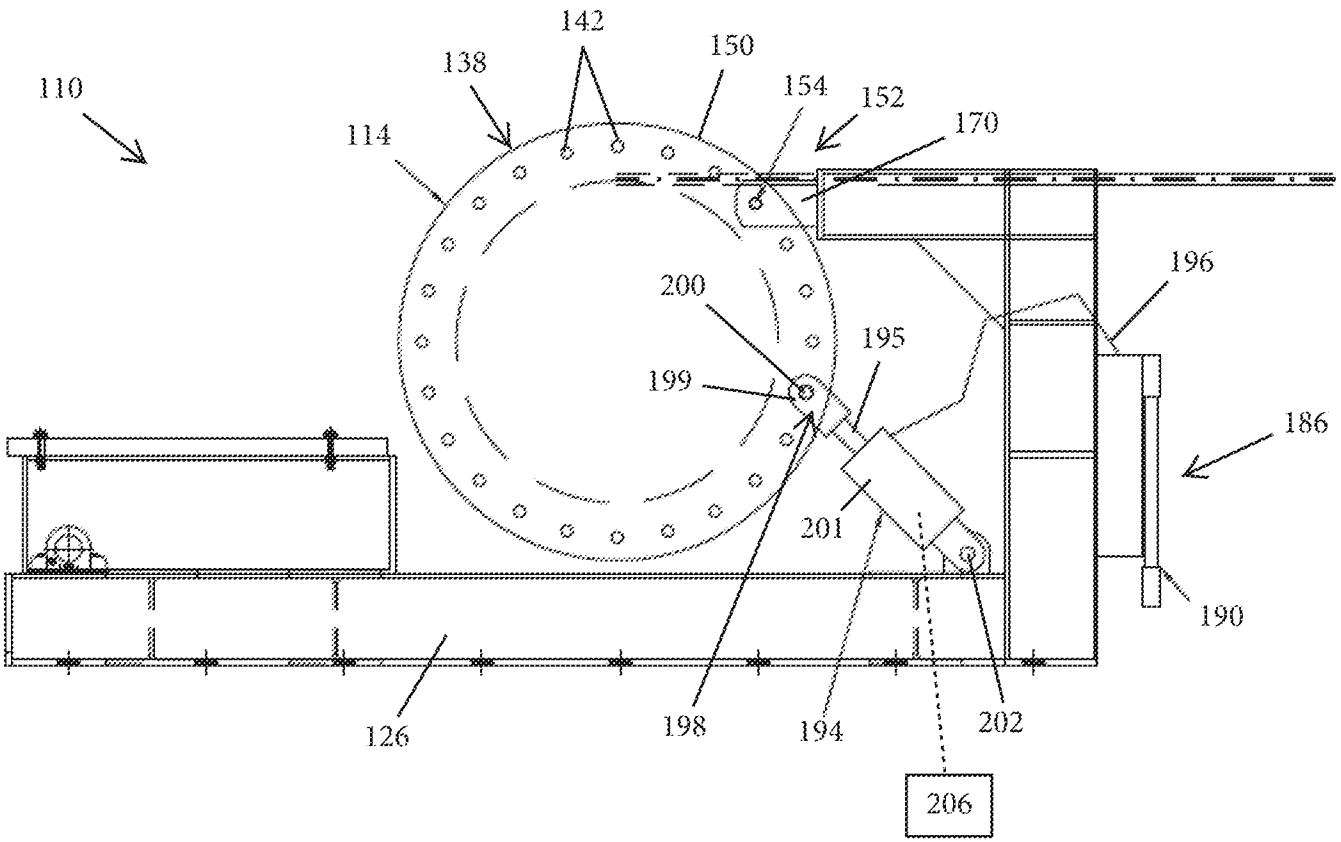
FIG. 8 is a schematic side view of the winch system of FIG. 7, illustrating a safety release mechanism.

With reference to FIGS. 7 and 8, the winch system 110 also includes a winch frame 126 and a conveyor (not shown) that extends through the winch frame 126. The winch drum 114 is coupled to the winch frame 126. A winch rope 136 is wound about the winch drum 114, and is used to move the conveyor. In some constructions, the winch drum 114 is a large-scale structure capable of constant application at approximately 80 kN (18000 lbf) and crash loading of approximately 297 kN (67500 lbf).

As illustrated in FIG. 7, the winch drum 114 includes a pair of outwardly extending flanges 138, 140 located at opposite ends of the winch drum 114. As illustrated in FIG. 8, the flange 138 includes holes 142. The flange 138 extends circumferentially about a rotational axis 144 (FIG. 7) of the winch drum 114, and the holes 142 are positioned circumferentially about the flange 138. The holes 142 are spaced evenly apart from each other along the flange 138. In some constructions, the flange 138 is a separate member coupled to a central portion 146 (FIG. 7) of the winch drum 114. In other constructions, the flange 138 is integrally formed with the central portion 146 or the flange 138 is retrofitted to an existing winch drum 114.

The flange 138 has a diameter greater than a diameter of the central portion 146 of the winch drum 114, and the holes 142 are located generally near an outer edge 150 of the flange 138, such that the holes 142 are located radially exterior to the central portion 146.

With reference to FIGS. 7-10, the winch system 110 includes a locking mechanism 152 positioned proximate the winch drum 114. The locking mechanism 152, in conjunction with the flange 138, forms part of an overall winch drum tension isolation system that isolates tension build-up in the conveyor. The locking mechanism 152 includes a locking member 154. In the illustrated construction, the locking member 154 is a spring-loaded pin, although in other constructions the locking member 154 is another structure, including a hydraulically activated pin, etc. In some constructions, and similar to the locking mechanism 52 described above, a housing (not shown) is coupled to the winch frame 126, and the locking member 154 slides within the housing. A distal end of the locking member 154 is received in one of the holes 142 of the flange 138 depending upon a position of the locking member 154. When the locking member 154 is in a first position, the distal end of the locking member 154 is received in one of the holes 142 and the locking member 154 inhibits movement of the winch drum 114. When the locking member 154 is in a second position, the distal end is spaced apart from and does not engage the flange 138 such that movement of the winch drum 114 is permitted.

In some constructions, the locking mechanism 152 includes a restraining mechanism (e.g., flanges similar to the flanges 67, 68, holes 69, and bolt described above) that restrains movement of the locking member 154 relative to the winch drum 114. The locking mechanism 152 is positioned on the winch frame 126 such that the locking member 154, and in particular the distal end of the locking member 154, is generally aligned radially with the holes 142. Based on rotational positioning of the winch drum 114, the distal end of the locking member 154 extends through one of the holes 142 when the restraining mechanism 66 is released.

With continued reference to FIGS. 7-10, the locking mechanism 152 includes guide members 170 located on either side of the flange 138 (similar to guide member 70 described above). Each of the guide members 170 includes an opening for receiving the locking member 154 and guiding the locking member 154 into alignment with one of the holes 142.

The flange 138 and the locking member 154 prevent rotation of the winch drum 114 (e.g., in the case of a brake seizure in a park brake), and isolate tension that builds up in the conveyor. In order to remove the stored energy safely, the flange 138 and the locking member 154 are utilized to lock rotation of the winch drum 114 and isolate the tension in the conveyor while replacement and/or repairs are made. In particular, if the distal end of the locking member 154 is initially aligned with one of the holes 142, the restraining mechanism is released, and the distal end of the locking member 154 moves towards the hole 142. In the illustrated construction, the locking member 154 is a biasing member biased toward the holes 142 by a spring element (not shown). Thus, when the restraining mechanism is released, the locking member 154 automatically moves toward the aligned hole 142. In other constructions, the locking member 154 may be moved manually toward the aligned hole 142.

With the locking member 154 received by the aligned hole 142 and the guide members 170, rotation of the winch drum 114 is prevented. With rotation of the winch drum 114 prevented, the motor 117, gear box 118, and/or other structures are removed and/or repaired, and the stored energy is then removed.

Figure 9:
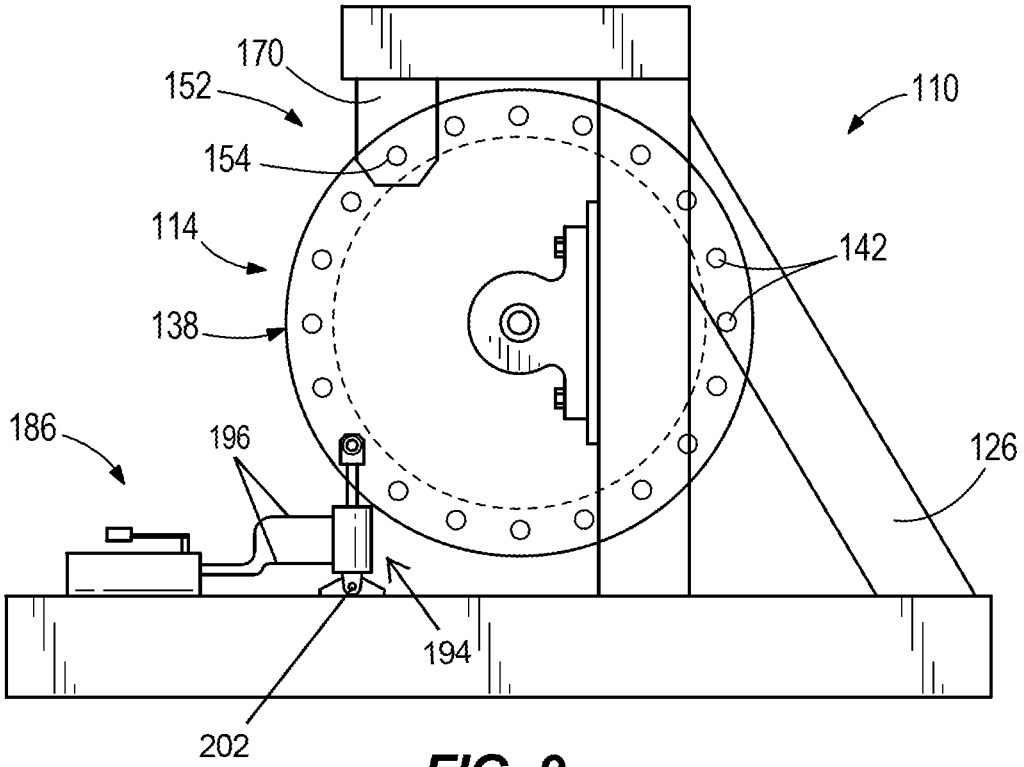
FIG. 9 is a schematic view of the winch system of FIG. 7, illustrating a different position for the safety release mechanism.
Figure 10:
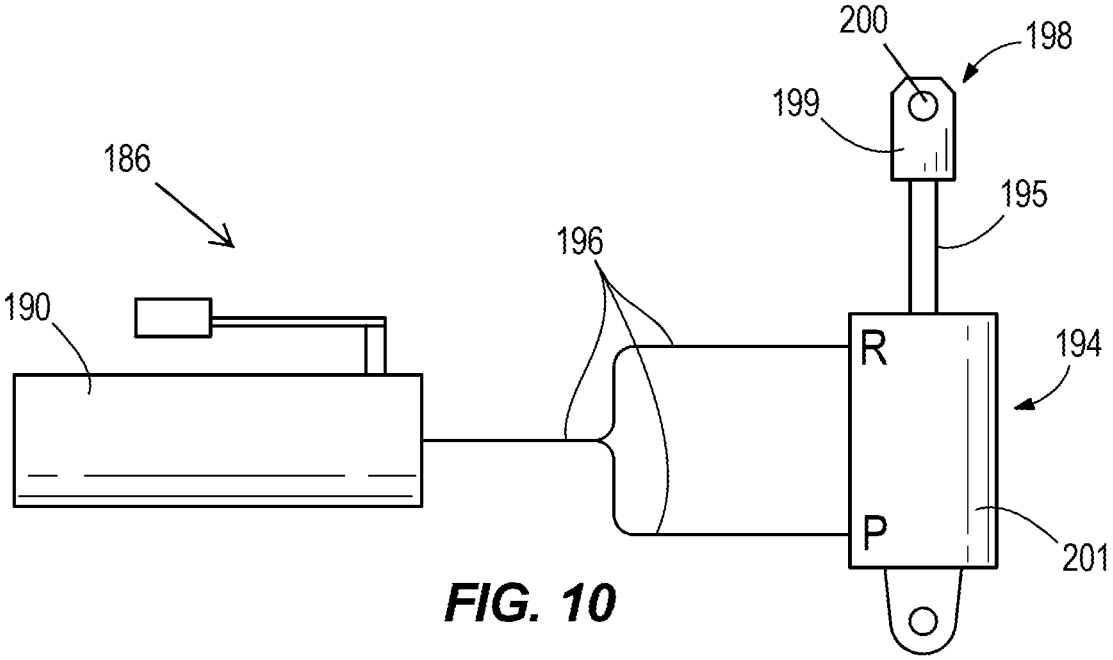
FIG. 10 is a schematic view of the safety release mechanism.

With continued reference to FIGS. 7-10, the winch system 110 also includes a safety release mechanism 186 to relieve tension off of the locking member 154 so that the locking member 154 may be removed from the flange 138 (e.g., after repairs have been made to the motor 117, gear box 118, or any other structure). In the illustrated construction, the safety release mechanism 186 includes a hydraulic hand pump 190, a hydraulic cylinder 194 (having an extending and retracting piston arm 195) coupled to the hydraulic hand pump 190 via one or more hydraulic lines 196 (FIG. 9 or 10), and a clevis/pin arrangement 198 coupled to the hydraulic cylinder 194. As illustrated in FIGS. 8 and 9, the hand pump 190 and hydraulic cylinder 194 may be coupled to the winch frame 126 in various locations. Additionally, as illustrated in FIGS. 8 and 9, the hydraulic cylinder 194 may be pivotally coupled to the winch frame 126 about a pivot point 202 (e.g., pivot pin).

To remove the locking member 154, the clevis/pin arrangement 198 includes a clevis 199 and a pin 200 that is inserted into one of the holes 142 and into the clevis 199 (e.g., through a hole or holes in the clevis 199. For example, with reference to FIGS. 8 and 9, the hydraulic cylinder 194 may be pivoted about the pivot point 202 (e.g., manually, or with a separate motor, or mechanically with a jack or other structure) until the clevis/pin arrangement 198 is positioned at one of the holes 142. The hydraulic cylinder 194 may alternatively or additionally be activated (e.g., extended or retracted via the hand pump 190) so that the piston arm 195 extends relative to a housing 201 of the hydraulic cylinder 194 and moves the clevis/pin arrangement 198 adjacent one of the holes 142. The pin 200 is then inserted into the hole 142 and coupled to the clevis 199 to couple the clevis/pin arrangement 198 to the flange 138. Thereafter, the hydraulic hand pump 190 is pumped to move the clevis/pin arrangement 198 further and thus force a slight rotation of the winch drum 114 and the flange 138, relieving tension around the locking member 154 so that the locking member 154 may be easily removed from its hole 142 and out of engagement with the flange 138.

Once the locking member 154 has been removed, the clevis/pin arrangement 198 is then removed from the hole 142 and flange 138. For example, the motor 117 and/or the park brake may be activated to control movement of the winch drum 114 (e.g., to hold the winch drum 114 still), until the clevis/pin arrangement 198 has been fully removed. The hydraulic cylinder 194 and the clevis/pin arrangement 198 are then retracted and/or rotated about the pivot point 202 from an active position (i.e., where the hydraulic cylinder 194 and the clevis/pin arrangement 198 are being used to engage the flange 138) to a storage position so that they do not block further movement and rotation of the winch drum 114 and its flange 138. In some constructions, the hydraulic cylinder 194 and clevis/pin arrangement 198 are rotated to a vertical storage position, to a horizontal storage position, or to any other angle of storage position, such that the hydraulic cylinder 194 and the clevis/pin arrangement 198 remain out of a path of movement of the winch drum 114 during use of the winch system 110.

In some constructions, the safety release mechanism 186 is also used to rotate the winch drum 114 and the flange 138 during the insertion of the locking member 154. For example, if the locking member 154 is not initially aligned with one of the holes 142, the safety release mechanism 186 may be used to engage the flange 138 (e.g., via the clevis/pin arrangement 198) and slightly rotate the winch drum 114 and flange 138 until the locking member is aligned with one of the holes 142. The locking member 158 may then be inserted into the hole 142. Subsequent to inserting the locking member 158 into the hole 142, the safety release mechanism 186 may then be removed from the flange 138, or in some construction may remain coupled to the flange 138 during the repair of the motor 117, the gear box 118, or any other structure on the winch system 110.

Other constructions include different types of safety release mechanisms 186 than that illustrated. For example, while the illustrated construction includes a hydraulic cylinder 194, other constructions include pneumatic cylinders or other types of actuators (e.g., linear actuators). In some constructions, the hydraulic hand pump 190 is not provided. Rather, the hydraulic cylinder 194 (or other actuator) is controlled electronically by a controller 206 (FIG. 8). Additionally, while the illustrated construction includes a clevis/pin arrangement 198, other constructions include clamps, spring-loaded pins, or other release members that extend into one of the holes 142 (or otherwise engage with the flange 138), such that the winch drum 114 and the flange 138 may be rotated slightly to relieve tension around the locking member 154 so that the locking member 154 may be removed. Additionally, while the illustrated construction includes a single pivot point 202 for moving the hydraulic cylinder 194 and the clevis/pin arrangement 198 between the active position and the storage position, in other constructions the hydraulic cylinder 194 and the clevis/pin arrangement 198 (or other structures that are being used) are moved via multiple pivot points, or via one or more tracks, guides, rails, or other structures (e.g., on the frame 126).

Although the invention has been described in detail with reference to certain preferred embodiments, variations and modifications exist within the scope and spirit of one or more independent aspects of the invention as described.

What is claimed is:

1. A winch drum tension isolation system comprising:

a winch drum including an outwardly extending flange, the flange including a plurality of holes spaced along the flange;

a locking mechanism positioned proximate the winch drum and including a locking member engageable with the flange, the locking member movable between a first position, in which the locking member is received in a first one of the plurality of holes to prevent forward or backward rotation of the winch drum, and a second position, in which the locking member is spaced apart from the flange to permit rotation of the winch drum; and a safety release mechanism that includes a release member that is selectively engageable with a second one of the plurality of holes to permit removal of the locking member, wherein the release member includes a pin, and wherein the safety release mechanism further includes a clevis, wherein the pin is configured to extend through the second one of the plurality of holes in the flange and into the clevis.

2. The winch drum tension isolation system of claim 1, wherein the safety release mechanism includes a hydraulic cylinder coupled to the release member.

3. The winch drum tension isolation system of claim 2, further comprising a frame, wherein the hydraulic cylinder is pivotally coupled to the frame.

4. The winch drum tension isolation system of claim 3, wherein the safety release mechanism includes a pump coupled to the hydraulic cylinder via at least one hydraulic line.

5. The winch drum tension isolation system of claim 4, wherein the pump is a hand pump.

6. The winch drum tension isolation system of claim 1, further comprising an internal gearbox disposed within the winch drum.

7. The winch drum tension isolation system of claim 1, wherein the winch drum includes a central portion having a first diameter, and the flange has a second diameter greater than the first diameter.

8. The winch drum tension isolation system of claim 1, wherein the plurality of holes are spaced circumferentially about the flange.

9. The winch drum tension isolation system of claim 1, wherein the pin is a first pin, wherein the locking member includes a second pin.

10. A winch drum tension isolation system comprising:

a winch drum including an outwardly extending flange, the flange including a plurality of holes spaced along the flange;

a locking mechanism positioned proximate the winch drum and including a locking member engageable with the flange, the locking member movable between a first position, in which the locking member is received in a first one of the plurality of holes to prevent forward or backward rotation of the winch drum, and a second position, in which the locking member is spaced apart from the flange to permit rotation of the winch drum;

a frame; and a safety release mechanism that includes a release member that is selectively engageable with a second one of the plurality of holes to permit removal of the locking member, wherein the safety release mechanism includes a hydraulic cylinder coupled to the release member, wherein the hydraulic cylinder is pivotally coupled to the frame.

11. The winch drum tension isolation system of claim 10, wherein the hydraulic cylinder includes a first end and a second, opposite end, wherein the first end is pivotally coupled to the frame, and wherein the release member extends from the second end.

12. The winch drum tension isolation system of claim 10, wherein the safety release mechanism includes a pump coupled to the hydraulic cylinder via at least one hydraulic line.

13. The winch drum tension isolation system of claim 12, wherein the pump is a hand pump.

14. The winch drum tension isolation system of claim 10, wherein the hydraulic cylinder is pivotally coupled to the frame about a pin.

15. The winch drum tension isolation system of claim 10, wherein the locking member includes a pin.

16. The winch drum tension isolation system of claim 10, wherein the release member includes a pin.

17. The winch drum tension isolation system of claim 16, wherein the pin is a first pin, wherein the locking member includes a second pin.

18. The winch drum tension isolation system of claim 17, wherein the hydraulic cylinder is pivotally coupled to the frame about a third pin.

* * * * *